US005176041A

United States Patent [19]

Meier et al.

[11] Patent Number: 5,176,041

[45] Date of Patent: Jan. 5, 1993

[54] CONTROL TRANSMITTER

[75] Inventors: Dietmar Meier, Tiefenbronn; Bernhard Lehmann, Möglingen, both of Fed. Rep. of Germany

[73] Assignee: Robert Bosch GmbH, Stuttgart, Fed. Rep. of Germany

[21] Appl. No.: 699,459

[22] Filed: May 13, 1991

[30] Foreign Application Priority Data

Jun. 1, 1990 [DE] Fed. Rep. of Germany ..... 4017696

[51] Int. Cl.[5] ..... G05G 9/02; H01C 10/16

[52] U.S. Cl. ..... 74/471 XY; 74/527; 338/128

[58] Field of Search ..... 74/471 XY, 527; 200/6 A; 338/128; 273/148 B

[56] References Cited

U.S. PATENT DOCUMENTS

| | | | |
|---|---|---|---|
| 2,958,233 | 11/1960 | Johnson | 74/471 XY X |
| 3,818,154 | 6/1974 | Presentey | 74/471 XY X |
| 3,827,313 | 8/1974 | Kiessling | 74/471 XY |
| 4,101,863 | 7/1978 | Lewicki | 74/471 XY X |
| 4,325,050 | 4/1982 | Suszynski | 74/471 XY X |
| 4,386,626 | 6/1983 | Hehl | 137/529 |
| 4,533,899 | 8/1985 | Isaksson | 74/471 XY X |
| 4,587,510 | 5/1986 | Kim | 74/471 XY X |
| 4,620,176 | 10/1986 | Hayes | 338/128 |
| 4,784,008 | 11/1988 | Paquereau et al. | 74/471 XY |

*Primary Examiner*—Allan D. Herrmann
*Attorney, Agent, or Firm*—Michael J. Striker

[57] ABSTRACT

A control transmitter, especially for hydraulic valves comprises a housing, a switching rod which is arranged in the housing deflectably in at least two main axes, a ball pivot turnably supporting the switching rod in the housing, two control brackets arranged perpendicularly to one another and turnably supported in the housing so that the switching rod is in operative connection with the control brackets, a rotary angle transmitter arranged on a bearing point of each of the control brackets, a spring-loaded sliding body arranged on the switching rod and having an outer edge which slides over a conically curved contour of the housing having different raising portions.

11 Claims, 5 Drawing Sheets

CONTROL TRANSMITTER

BACKGROUND OF THE INVENTION

The present invention relates to a control transmitter (generator). More particularly, it relates to a control transmitter especially for hydraulic valves which has housing and a switching rod which is deflectably mounted in the housing for moving about at least two main axes.

Control transmitters of the above mentioned general type are known in the art. Such known control transmitters have a simple construction. However, they are no longer suitable for the requirements of advanced technology.

SUMMARY OF THE INVENTION

Accordingly, it is an object of the present invention to provide a control transmitter which avoids the disadvantages of the prior art.

More particularly, it is an object of the present invention to provide a control transmitter which only with insignificantly high expenses, provides for a significant operational improvement and is suitable especially for emergency cases.

In keeping with these objects and with others which will become apparent hereinafter, one feature of the present invention resides, briefly stated, in a control transmitter in which the switching rod is supported on a ball pivot arranged in the housing and is in operative connected with two control brackets which are perpendicular to one another and supported turnably in the housing, and a rotary angle transmitter, especially a potentiometer, is arranged at each bearing point of each control bracket, while a spring-loaded sliding body is arranged on the switching rod and slides with its outer edge on a conically curved contour of the housing with different pitches or inclinations.

When the control transmitter is designed in accordance with the present invention, it achieves the above mentioned objects.

In accordance with another feature of the present invention, the ball pivot is located in a control housing which is mounted on the housing of a control transmitter and has a firt square projection with the bearing points for the control brackets, and a second inner projection with a conically curved contour having a circular periphery.

Still another feature of the present invention is that the rotary axes of the control brackets and the ball pivot of the switching rod are in the same plane.

In accordance with a further feature of the present invention, a sliding pin is arranged at the lower end of the projection of the control housing and is displaces on the switching rod. The sliding pin abuts against an arresting plate which has an inner spherical-surface region with a center corresponding to the rotary point of the bearing of the switching rod, and an outer concentric, deeper, spherical surface shaped region with the same direction of curvature as the first region and arranged concentrically with the first region.

In accordance with a further feature of the present invention, a falling edge can be formed between the inner region and the outer region of the surface of the arresting plate.

The rotary angle transmitter can be adjusted from outside, for example by means of knurled disc.

Finally, the control transmitter can be an operative connection through the rotary angle transmitter with a proportional valve of a control displacement valve.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
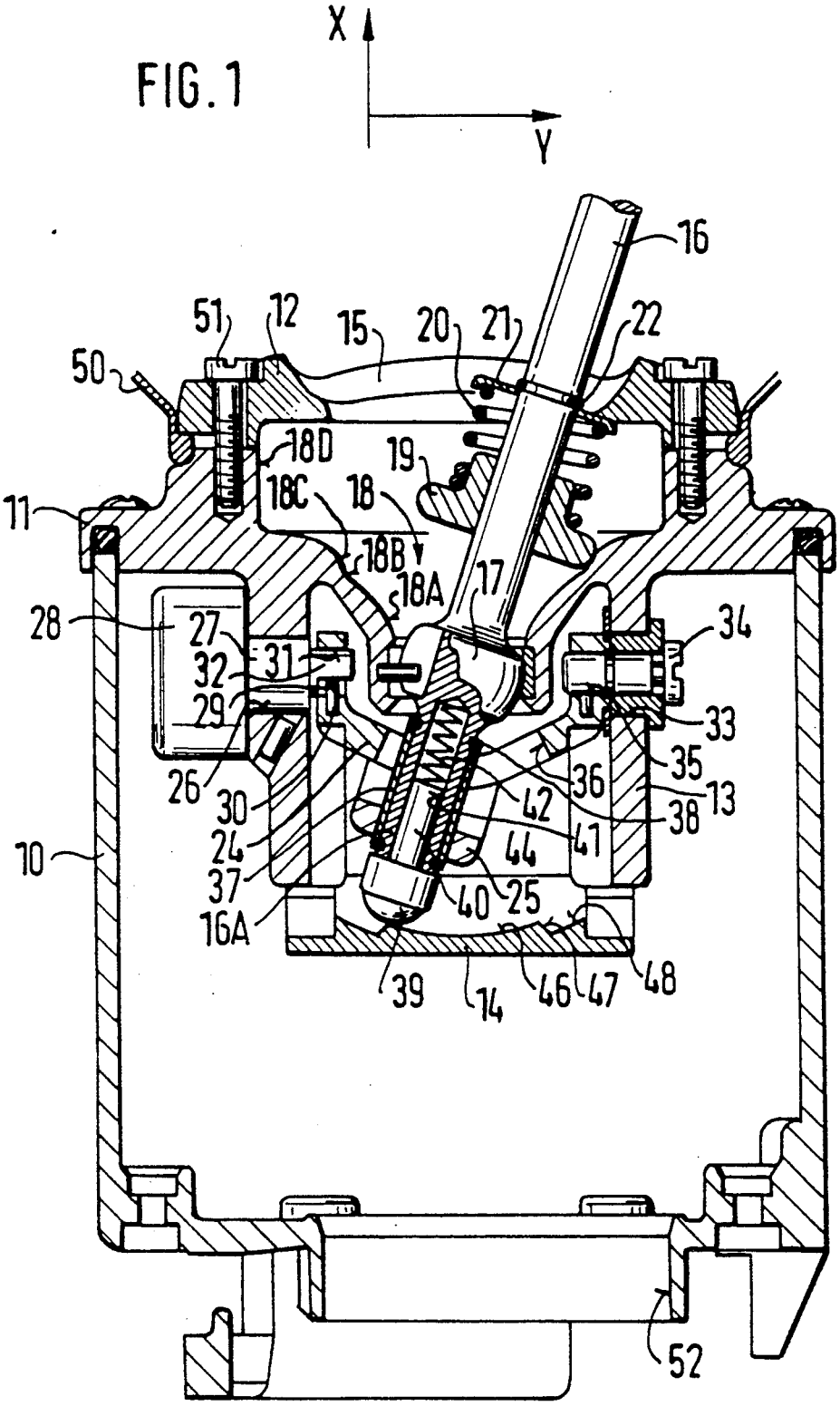
FIG. 1 is a view showing a longitudinal section of the control transmitter in accordance with the present invention.
Figure 2A:
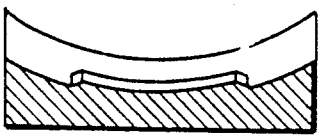
FIGS. 2A–2D are views showing some details of an arresting plate of the inventive control transmitter.
Figure 2B:
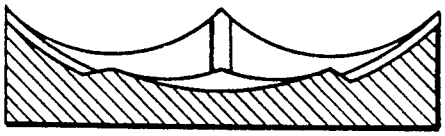
Figure 2C:
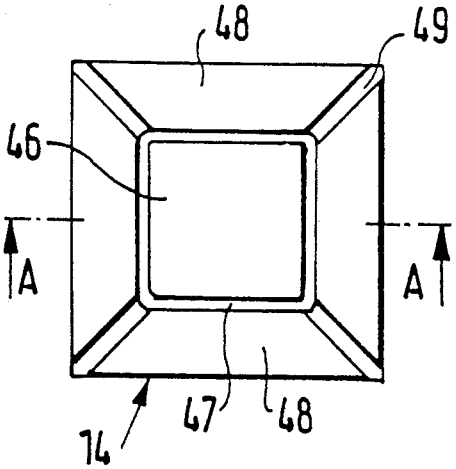
Figure 2D:
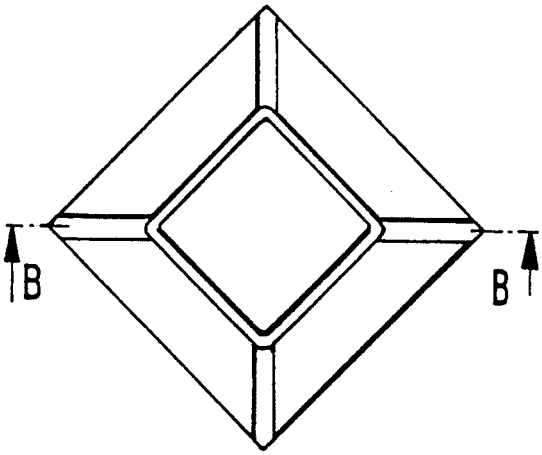

A substantially cup-shaped housing of the control transmitter in accordance with the present invention is shown in FIG. 1 and identified with reference numeral 10. A control housing 11 is arranged on its open upper part and is closed by a template 12. The control housing 11 has an open projection 13 with a square cross-section. The projection 13 extends into the housing 10 and is provided with an arresting plate 14 on its lower side. A coulisse 15 is located in the template 12 and provided for a switching rod 16. The switching rod 16 extends to the end of the projection 13 in the housing, or in other words, down to the arresting plate 14.

The switching rod 16 is supported in a wall pivot 17 which is a part of a funnel-shaped projection 18. The projection 18 substantially conically reduces toward the arresting plate 14 and ends in the ball pivot 17. The shape of the projection 18 is strongly conical in its lower part 18A and slightly curved. Then a ring-groove-shaped circular depression 18B follows, and again a strongly conical curved zone 18C is located above. Then it is flattened and ends in the cylindrical end part 18D. The whole above described contour is circular.

A ring-shaped sliding piece 19 is displaceably arranged on the switching rod 16 above the ball pivot 17. A pressure spring 20 acts on a sliding piece 19 and supported on a spring plate 21. The spring plate 21 is mounted on the switching rod by a spring ring 22 and extends in the coulisse 15. The pressure spring 20 presses the sliding piece with its rounded outer side against the surface of the projection 18.

The part of the switching rod which is located below the ball pivot 17 is in operative connection with two deviating brackets 24 and 25. The deviating brackets 24 and 25 extend perpendicularly relative to one another and are supported on a projection 13 of the control housing 11 in a turnable fashion. Only the control bracket 24 is described, since the control bracket 25 is formed and supported similarly. A pin 27 of the rotary angle transmitter 28 (potentiometer) is supported in a transverse opening 26 of the housing. A further pin 32 is connected with the pin 27 and has a substantially smaller diameter. It extends into the control housing and more particularly in the space between the projection 13 and the projection 18. The pin 32 has a flattening 29. The pin 30 abut against the flattening 29 and extends in an opening 31 of the bracket 24.

An opening 33 is provided in the projection 13 and extends axes parallel and diametrically opposite to the opening 26. A bearing pin 34 is supported in the opening 13 and extends into the control housing. The control bracket 24 is supported with its bearing opening 35 on the bearing pin 34. The control bracket 24 has in its central part a longitudinal slot 36. The lower part 16 of the switching rod extends through the longitudinal slot 36. A sliding bush 37 is supported on this part on the switching rod and fixed at both sides by spring rings 38. A pressing pin 39 extends with its shaft 40 into a longitudinal opening 41 of the switching rod, in which a pressure spring 42 is arranged. The pressure spring 42 presses the pressing pin 39 against the arresting plate 14. Turning of the switching lever 16 about the ball pivot 17, the lower part 16A of the switching lever moves in the slot 36 of the control bracket 34 in a plane identified with reference Y.

The control bracket 25 is formed as the control bracket 24. The switching lever 16 extends through this control bracket in the region of the sliding bush 37 through its longitudinal slot 44 which corresponds to the longitudinal slot 36 in the switching bracket 24. The switching lever 16 is turnable through the restrain in the sliding bracket around the ball pivot 17 in a plane X which is perpendicular to the plane 20.

The arresting plate 13 which is shown also in FIGS. 2A–2D have a surface 46 which is provided in its center and faces the switching rod. Its part is formed as a circle surface with a center located in the axis of the switching rod 16 when it is located exactly in perpendicular central position. The surface 46 extends far outwardly and has a square form as seen above in FIG. 2C. It ends in an edge 47 which extends around and falls down. The edge 47 merges around in an outwardly located surface 48 which also has the shape of a spherical surface and extends eccentrically relative to the surface 46. Diagonal grooves 49 extend from the corner points of the surface 46.

Figure 3:
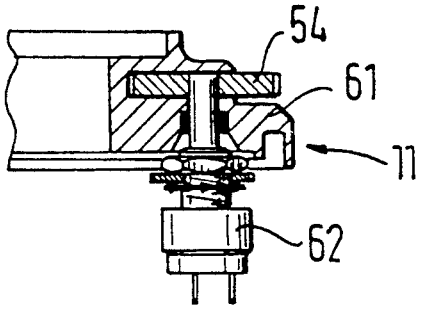
FIG. 3 is a view showing a section of a housing part of the inventive control transmitter.
Figure 4:
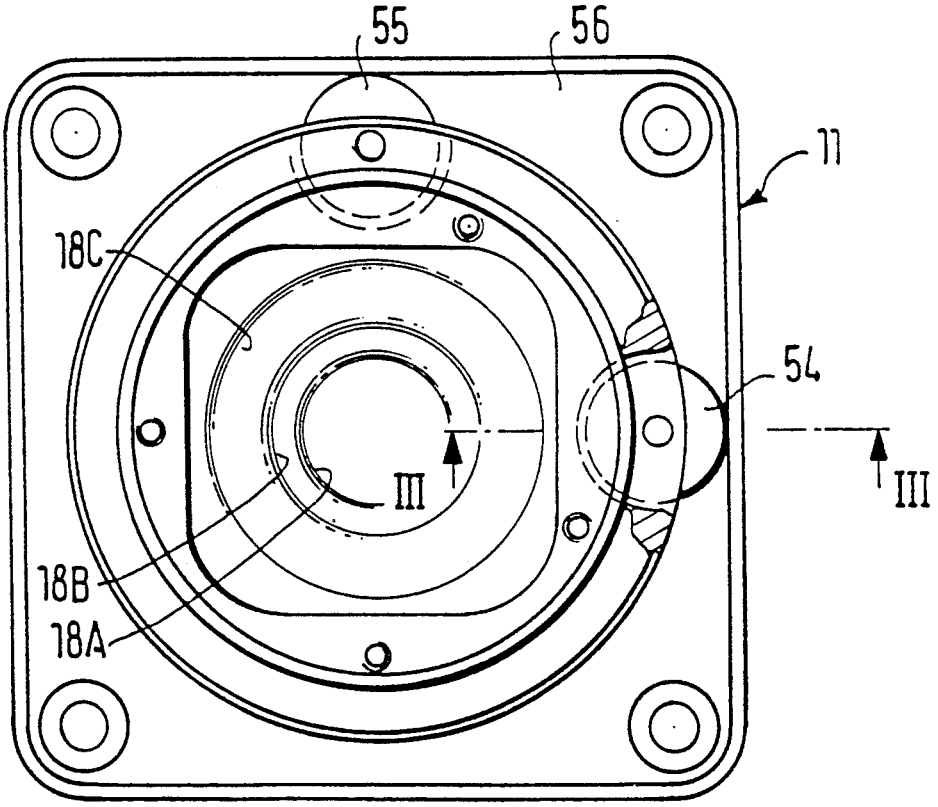
FIG. 4 is a plan view of the housing part of FIG. 3 of the control transmitter.
Figure 5:
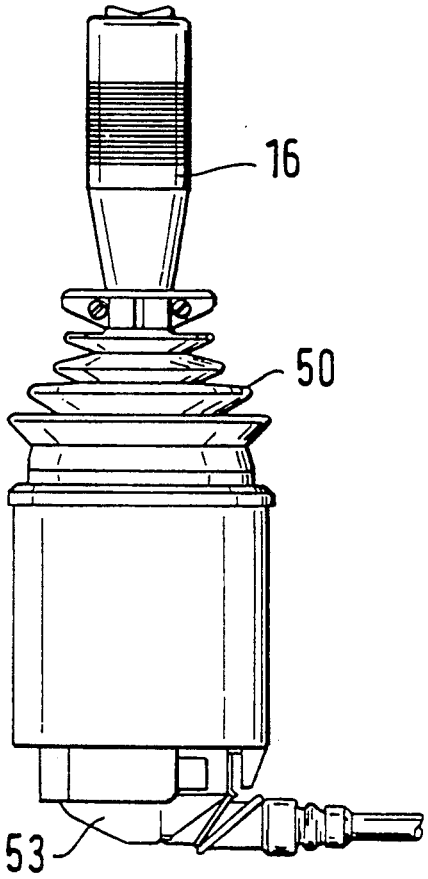
FIG. 5 is a side view of the control transmitter in accordance with the present invention.

It should be mentioned that the arresting plate 14 is naturally fixedly arranged on the projection 13 of the control housing 11. A rubber hood 50 is mounted between the template 12 and the control housing 11. It tightly seals the whole control transmitter relative to the switching rod 16. The template 12 is connected by screws 51 with the control part 11. A cable lug 53 is located in the lower opening 52 of the housing 10 as shown in FIG. 5. Both potentiometers, of which only one potentiometer 28 is shown, are adjustable from outside. This can be seen from FIGS. 3 and 4. An knurled nut 54 which belongs to an adjusting potentiometer 62 is located in a flange 61 of the control housing 11 and adjusts the potentiometer 28 to a predetermined nominal value. A second knurled nut 55 which belongs to another adjusting potentiometer 62 can adjust the rotary angle transmitter actuated by the control bracket 25.

Figure 6:
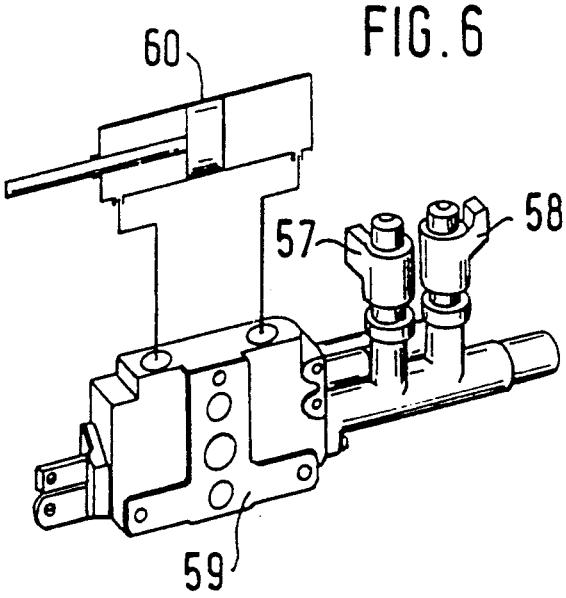
FIG. 6 is a view showing an application of the control transmitter in accordance with the present invention.
Figure 7:
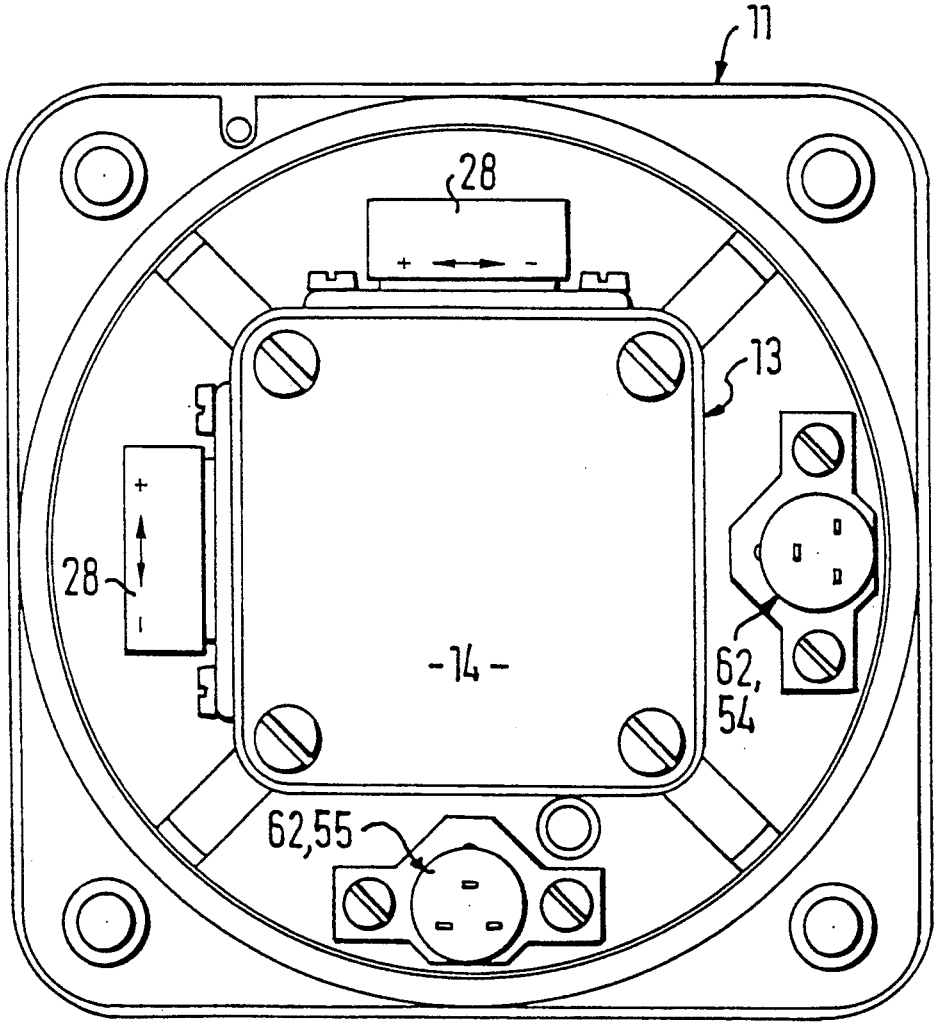
FIG. 7 is a view showing an open control housing of the control transmitter.

The inventive control transmitter is especially suitable for actuation of proportional magnets 57, 58 of a displacement valve 59, for controlling a working cylinder-piston unit 60 shown in FIG. 6.

The control transmitter or the switching rod 16 can simultaneously deviate in the directions of both main axes X and Y. During the deviation of the switching rod 16 from its central position, the sliding piece 19 slides along the switching rod and is guided with its outer contour on the curved conical contour 18A–18C of the control housing 11. In this contour, as described, the steep edge 18C, so that during reaching of a predetermined deviation angle in the X or Y direction, an increase of the actuating force is obtained due to the increased friction force on the sliding piece. Therefore the device has a very good sensing for an operator with respect to the magnitude of the deviation. With the help of the control transmitter the speed of the hydraulic adjusting member, in this case the working cylinder-piston unit, is adjusted in an optimal manner to the respective different working processes. The adjusting possibility is obtained by the rotary angle transmitter. The resistance change causes a sensitivity change of the electronic part, which acts on the magnitude of the electrical current for the controlling of the proportional valve 57 and 58 at a predetermined angle of the switching rod which is operative for the deviation of the control slider in the displacement valve and thereby for the volume stream in the working cylinder-piston unit 60. The arrangement of both potentiometers is selected so that a reliable association for both axes is insured and an unauthorized displacement is avoided. The potentiometers are adjusted by the knurled discs 54 and 55.

After reaching or exceeding a predetermined deviation angle, the switching rod after freeing the same must remain in the control transmitter deviated with a predetermined angle (arresting position) and brought out with an increased force from this arresting position to a rest position. This is achieved by means of the arresting plate 14 and the pressing pin 39. The pressing pin slides at reaching or exceeding a predetermined deviation angle, the switching rod from the inner spherical surface 46 to the outer spherical surface 48. The pretensioning of the pressing pin 39 is sufficient to counteract the return forces of the spring 2 over the sliding piece 19. During exceeding of the predetermined deviation angle in both axes, the pressing pin is guided by the groove 49 on the arresting plate in this position and held there.

It will be understood that each of the elements described above, or two or more together, may also find a useful application in other types of constructions differing from the types described above.

While the invention has been illustrated and described as embodied in a control transmitter, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A control transmitter, especially for hydraulic valves, comprising a housing; a switching rod which is arranged in said housing deflectably in at least two main axes; a ball pivot turnably supporting said switching rod in said housing; two control brackets arranged perpendicularly to one another and turnably supported in said housing so that said switching rod is in operative connection with said control brackets; a rotary angle transmitter arranged on a bearing point of each of said control brackets; a spring-loaded sliding body arranged on said switching rod and having an outer edge which slides over a conically curved contour of said housing having different raising portions.

2. A control transmitter as defined in claim 1, wherein said rotary angle transmitter is a potentiometer.

3. A control transmitter as defined in claim 1; and further comprising a control housing which is mounted on said housing so that said ball pivot is formed in said control housing.

4. A control transmitter as defined in claim 3, wherein said control housing has a first square projection in which bearing points for said control brackets are formed, and a second inner projection on which said conically curved contour is formed with a circular periphery.

5. A control transmitter as defined in claim 1, wherein said control brackets have axes of rotation, and said ball pivot has axes of rotation which are located in same planes.

6. A control transmitter as defined in claim 4, wherein said first square projection of said control housing has a lower end; and further comprising a spring-loaded sliding pin arranged at said lower end of said first square projection of said control housing; and an arresting plate against which said sliding pin abuts.

7. A control transmitter as defined in claim 6; and further comprising a bearing for said switching rod and having a point of rotation, said arresting plate having an inner region with a spherical surface with a center corresponding to said point of rotation of said bearing of said switching rod, and also having a concentric region with spherical surface located deeper and having the same direction of curvature as said first mentioned region and extending concentrically to said first mentioned region.

8. A control transmitter as defined in claim 7, wherein said arresting plate has a falling edge located between said first mentioned and said second mentioned regions.

9. A control transmitter as defined in claim 1; and further comprising means for adjusting said rotary angle transmitter from outside.

10. A control transmitter as defined in claim 9, wherein said means for adjusting said rotary angle transmitter includes knurled discs.

11. A control transmitter as defined in claim 1, wherein said rotary angle transmitter is adapted to be in operative connection with a proportional valve of a control displacement valve.

* * * * *